US011674333B2

(12) United States Patent
Milligan et al.

(10) Patent No.: US 11,674,333 B2
(45) Date of Patent: Jun. 13, 2023

(54) ELECTRONIC LOCK FOR CASEWORK SLIDING DOORS

(71) Applicant: Accuride International Inc., Santa Fe Springs, CA (US)

(72) Inventors: Charles Milligan, Placentia, CA (US); Todd Watanabe, Rowland Heights, CA (US)

(73) Assignee: Accuride International Inc., Santa Fe Springs, CA (US)

( * ) Notice: Subject to any disclaimer, the term of this patent is extended or adjusted under 35 U.S.C. 154(b) by 1105 days.

(21) Appl. No.: 16/118,322

(22) Filed: Aug. 30, 2018

(65) Prior Publication Data

US 2019/0063113 A1 Feb. 28, 2019

Related U.S. Application Data

(60) Provisional application No. 62/551,962, filed on Aug. 30, 2017.

(51) Int. Cl.
*E05B 47/00* (2006.01)
*E05C 1/08* (2006.01)
(Continued)

(52) U.S. Cl.
CPC ..... *E05B 47/0012* (2013.01); *E05B 47/026* (2013.01); *E05B 65/0864* (2013.01);
(Continued)

(58) Field of Classification Search
CPC ..... E05C 19/028; E05C 1/002; E05C 1/08; E05C 1/085; E05B 65/44; E05B 65/08;
(Continued)

(56) References Cited

U.S. PATENT DOCUMENTS 5,421,178 A * 6/1995 Hamel ..... E05B 47/0661 292/144
5,473,922 A * 12/1995 Bair ..... E05B 47/026 292/144
(Continued)

FOREIGN PATENT DOCUMENTS

CN 200940381 Y 8/2007
CN 200985682 Y 12/2007
(Continued)

OTHER PUBLICATIONS

"Flange." Merriam-Webster.com Dictionary, Merriam-Webster, https://www.merriam-webster.com/dictionary/flange. Accessed Mar. 18, 2022. (Year: 2022).*
(Continued)

*Primary Examiner* — Kristina R Fulton
*Assistant Examiner* — Emily G. Brown
(74) *Attorney, Agent, or Firm* — KOS IP Law LLP

(57) ABSTRACT

An electronic locking device to secure linear transitioning or sliding doors. The electronic lock may include a bolt driven by a motor between a locked or extended position and an unlocked or retracted position. The bolt may be coupled to a sled, the sled moved by the motor between a forward position, placing the bolt in the locked position, and a rearward position, placing the bolt in the unlocked position. The motor may drive a drive screw to move the sled.

19 Claims, 19 Drawing Sheets

(51) Int. Cl.

| | |
|---|---|
| ***E05B 65/08*** | (2006.01) |
| ***E05B 65/44*** | (2006.01) |
| ***E05B 47/02*** | (2006.01) |
| ***E05C 19/02*** | (2006.01) |

(52) U.S. Cl.
CPC ..... *E05B 65/44* (2013.01); *E05C 1/085* (2013.01); *E05C 19/028* (2013.01); *E05B 2047/0094* (2013.01); *E05Y 2201/422* (2013.01); *E05Y 2201/434* (2013.01); *E05Y 2400/32* (2013.01); *E05Y 2900/202* (2013.01)

(58) Field of Classification Search
CPC ..... E05B 65/0864; E05B 47/026; E05B 47/0012; E05B 63/0052; E05B 47/0001; E05B 2047/0016; E05B 2047/0023; Y10T 292/1021; E05Y 2900/202
USPC ..... 292/32
See application file for complete search history.

(56) References Cited

U.S. PATENT DOCUMENTS

| | | | | |
|---|---|---|---|---|
| 5,896,765 | A * | 4/1999 | Peyre | E05B 47/0012 292/144 |
| 6,212,923 | B1 * | 4/2001 | Clark | E05B 47/0012 70/333 R |
| 6,435,573 | B1 | 8/2002 | Szablewski | |
| 6,722,167 | B1 | 4/2004 | Hsu | |
| 6,813,916 | B2 * | 11/2004 | Chang | E05B 47/0012 292/144 |
| 8,495,899 | B2 * | 7/2013 | Gartner | E05B 63/0017 70/278.1 |
| 8,726,707 | B1 | 5/2014 | Burpee | |
| 9,580,934 | B2 * | 2/2017 | Baty | E05B 47/02 |
| 9,657,501 | B2 * | 5/2017 | Armari | E05B 47/0047 |
| 10,240,366 | B2 * | 3/2019 | Sotes Delgado | E05B 65/46 |
| 10,465,423 | B2 * | 11/2019 | Wong | E05B 47/0661 |
| 10,508,470 | B2 * | 12/2019 | Raatikainen | E05B 47/0012 |
| 2003/0024288 | A1 * | 2/2003 | Gokcebay | E05B 63/06 70/432 |
| 2004/0207210 | A1 | 10/2004 | Luker | |
| 2012/0198897 | A1 * | 8/2012 | Lui | E05B 47/0673 70/280 |
| 2013/0033045 | A1 * | 2/2013 | Worm | E05B 65/0075 292/5 |
| 2016/0060904 | A1 * | 3/2016 | Dore Vasudevan | E05B 47/0673 292/144 |
| 2017/0102058 | A1 | 4/2017 | Stephenson | |
| 2017/0254116 | A1 | 9/2017 | Grant et al. | |
| 2018/0023321 | A1 | 1/2018 | Van Landingham, Jr. et al. | |
| 2018/0051486 | A1 * | 2/2018 | Yuan | E05B 65/0082 |
| 2020/0270903 | A1 * | 8/2020 | Stein | E05B 47/0607 |

FOREIGN PATENT DOCUMENTS

| | | | | |
|---|---|---|---|---|
| CN | 204024236 | U | 12/2014 | |
| CN | 205078022 | U | 3/2016 | |
| JP | 2006-057304 | A | 3/2006 | |
| JP | 2013-181380 | A | 9/2013 | |
| KR | 20-0456982 | Y1 | 11/2011 | |
| KR | 10-1409397 | B1 | 6/2014 | |
| WO | WO 99/35356 | A1 | 7/1999 | |
| WO | WO-2004020769 | A1 * | 3/2004 | E05B 47/0047 |
| WO | WO 2017/142908 | A1 | 8/2017 | |

OTHER PUBLICATIONS

Extended European Search Report (EESR) on related European Application No. 18850512.7from the European Patent Office (EPO) dated Apr. 26, 2021.

Office action on related China Application No. 201880068042.5 from the China National Intellectual Property Administration (CNIPA) dated Dec. 3, 2020.

International Search Report on related PCT Application No. PCT/US2018/048970 from International Searching Authority (KIPO) dated Jan. 7, 2019.

Written Opinion on related PCT Application No. PCT/US2018/048970 from International Searching Authority (KIPO) dated Jan. 7, 2019.

* cited by examiner

ELECTRONIC LOCK FOR CASEWORK SLIDING DOORS

CROSS REFERENCE TO RELATED APPLICATION

This application claims the benefit of the filing date of U.S. Provisional Patent Application No. 62/551,962, filed on Aug. 30, 2017, the disclosure of which is incorporated by reference herein.

BACKGROUND OF THE INVENTION

This invention relates generally to the field of cabinetry, and, more particularly, to an electronic latching and locking system to secure linear transitioning (sliding) doors.

Retail display cases are often secured. Conventional mechanical key lock device and other devices may be either inadequate in terms of security and/or require positioning that interfere with the customers line of sight to the items displayed within glass showcases.

BRIEF SUMMARY OF THE INVENTION

In some embodiments, a lock includes a bolt driven by a motor between a locked or extended position and an unlocked or retracted position. In some embodiments the bolt is coupled to a sled, the sled moved by the motor between a forward position, placing the bolt in the locked position, and a rearward position, placing the bolt in the unlocked position. In some embodiments the motor drives a drive screw to move the sled. In some embodiments the sled is slip fit over a casing for the drive screw, allowing for manual retraction of the sled. In some embodiments the bolt is a latch bolt, with the bolt spring loaded onto the sled, with the spring biasing the bolt towards a locked position.

In some embodiments, the lock is an electronic lock with a low profile electronic lock, allowing for installation into cabinetry using existing guide tracks and hardware used for sliding doors. In some embodiments the lock may be retrofitted easily into existing cabinetry as well as easily installed into new cabinetry.

In one embodiment, a drive screw is used to translate a latching/locking bolt, which may also be referred to as a pin. In some embodiments a four start drive screw is used, for example to increase the speed of the latching/lock pin while allowing for higher torque, lower speed, low voltage DC gear motor that fits within the limitations of the profile height that is less than ½ inch. In some embodiments the drive screw is a four start drive screw.

In accordance with various embodiments, the electronic lock secures linear transitioning panels or doors.

In some embodiments, the lock is a locking device providing for installation adjustability. A lock body provides two slotted holes located nearest to the pin, or bolt. These slotted holes allow an installer to refine a position or gap between a sliding panel and the lock body for optimum engagement of the lock to the panel or door. Once the adjustment is complete, the installer may use the two rearward round fixing hole to secure the lock in its optimum location.

In some embodiments the locking device is also equipped with a manual release device. This is a way for the lock to be released in the event of a power failure and access is desired to the lockable enclosure. The manual release or manual override feature can be a lanyard with the loop on the end coupled to the sled. To activate the manual release the lanyard is pulled away from the lock body, which then will manually retract the pin on the opposite end of the lock body thereby releasing the adjacent panel and allow access to the enclosure. Access to this lanyard may be restricted to ensure the integrity of the secure feature of the locking device.

In some embodiments the lock device provides for a minimum of mechanical moving components. The result of fewer moving components may allow for a more robust design resulting in higher quality and increased durability lower manufacturing cost and lower capital investment. The design comprises, and consists in some embodiments, of a base plate, a low voltage DC gear motor, a lead screw, a slip nut, a sled linkage, a circuit board, compression springs, a 4 way lock pin, a screw to secure the lock pin, manual release lanyard, two wires and eight enclosure screws.

Some embodiments also provide for ease of assembly. In some embodiments all of the internal lock components are positioned and installed into the base plate without the need for fasteners. Once the components are installed, the cover can be placed over the assembly and the 8 screws installed to complete the assembly and secure all of the internal components.

In addition to the lock assembly components, some embodiments include a cosmetic cover to shield the installation hardware, a spacer plate to allow the locking mechanism to clear any sliding door track hardware or framing when the lock is installed into the enclosure and surface mounted catches to allow for installation and locating the locks to engage with glass panels or solid surface panels such as wood.

In some embodiments the lock can withstand break forces in excess of 150 lbf. With modifications to the materials used to construct the lock components such as reinforced polymers and/or metal alloys the withstandable break force will increase.

In an alternate embodiment, a deadbolt is used. Such an embodiment may include a straight locking pin and a captured sleeve nut to the sled link and removing the spring bias. There is also a modification to the circuit firmware to drive the pin from the lock to unlocked position and then wait for a signal from the access control device the then drive the pin to the locked position from the unlocked position.

In some embodiments the lock features a simple connection that uses low DC voltage, provides a lock status output to allow for monitoring the lock status and a simple DC trigger input to activate and deactivate the unlock and lock sequence.

Some embodiments use an onboard microprocessor to manage the firmware and lock features and functions. In some embodiments there is an onboard power supply and other hardware that allows for a range of operational input DC voltage from 6 to 24 volts. In addition, in some embodiments the circuitry is protected from over voltage and reverse voltage condition.

In some embodiments internal logic of the circuit regulates power consumption of the lock during its duty cycle and also compensates for increased torque requirements due to interference or preload on the lock pin. For example, if the panel or door that is secured with this locking device is exerting forces on the lock pin at the time when an unlock command is given to the circuit the logic will identify this interference an increase the amount of power provided to the gear motor to overcome this resistance. This may optimize power consumption of the lock by limiting the power supplied to the motor unless the motor demands more power to complete the unlock cycle. The conditions that may require increase power are, in some embodiments, a door or panel exerting a force on the pin due to human interaction, someone is trying to open the door before the lock receives an unlock command or the door or panel is mechanically spring biased to auto open at the time an unlock command is given.

In some embodiments a catch for the lock captures the pin. The captured pin design of the lock may prevent lifting of the panel or door in the locked position to defeat the lock. Some lock systems use a mechanical pin to block the horizontal travel of the sliding door. To prevent the door from being lifted over this pin the door manufacture may provide a spacer that resides in the upper channel of the sliding door frame over the door in the locked position thus blocking the gap between the top of the door and the inside of the top frame. This gap may prevent the lock from being defeated. With some embodiments of the electronic lock, the pin is completed captured, preventing the panel or door from being lifted and maintaining a secure enclosure.

In some embodiments onboard optic sensors are used in managing the lock function and provide lock position feedback to a microprocessor, which may be used to control operation of the motor. In some embodiments a sled linkage includes a flag that protrudes from the back portion of the sled linkage. This flag is positioned to engage with two optic break beam sensors. In the forward position, the flag engages the forward most sensor. At this point, the activation of this sensor is monitored by the circuit controller and identifies this as the locked position. This information is used by the microprocessor and firmware to control the motor and control the status output. Similarly, the optic sensor at the rearward position identifies when the sled linkage is retracted to the unlock position. This information is used by the microprocessor and proprietary firmware to control the drive operation of the gear motor and to identify the position of the sled linkage.

The lead screw direct drive of some embodiments is a four-start screw. In some embodiments this provides maximum linear displacement in the least number of revolutions and utilizes a minimal amount speed and torque. In some embodiments full pin retraction and return is accomplished in an approximate 250 mS.

Some embodiments in accordance with aspects of the invention provide a lock assembly, comprising: a housing; a motor within the housing; a drive screw within the housing, the drive screw driveable by the motor; a coupling translatable through operation of the drive screw; a sled coupled to the coupling; and a bolt coupled to the sled, the bolt extendable through an aperture of the housing and retractable into the housing.

These and other aspects of the invention are more fully comprehended upon review of this disclosure.

DETAILED DESCRIPTION

Figure 1:
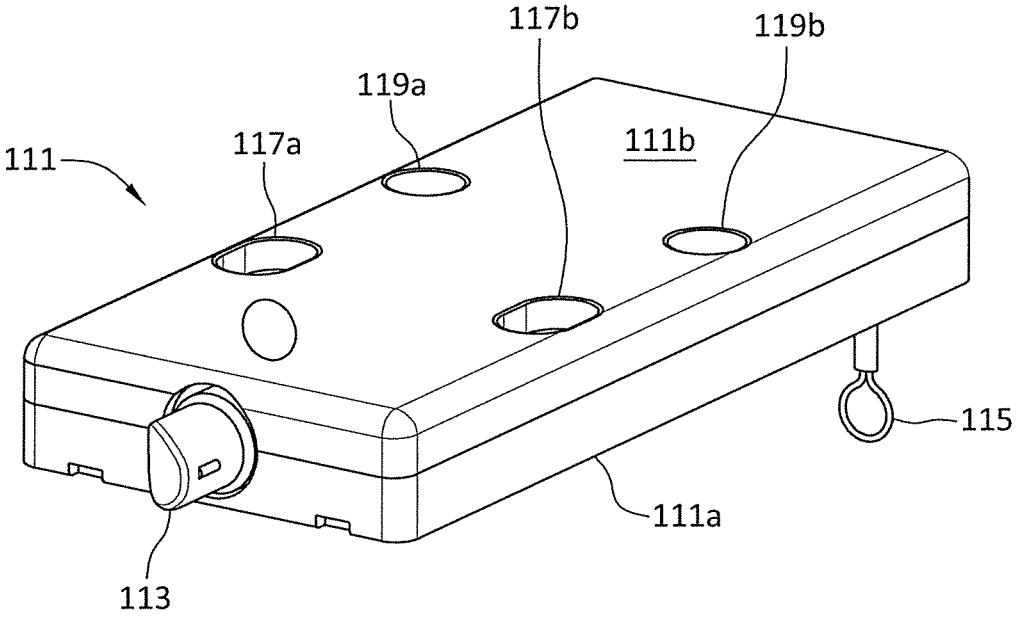
FIG. 1 is an isometric view of a lock assembly in accordance with an embodiment of the invention.

FIG. 1 is an isometric view of a lock assembly in accordance with an embodiment of the invention. The lock assembly includes a housing 111, with a bolt 113 shown extending from an aperture in one side of the housing. The bolt is generally extendable from and retractable into the housing by activation of a motor (not shown in FIG. 1).

The housing, in the embodiment of FIG. 1, is of generally a parallelpiped shape. The housing is formed of a bottom 111*a*, or base, and a top 111*b*, or cover, with the bottom and top removable from one another so as to provide access to contents of the housing. The aperture, in the embodiment of FIG. 1, is formed on a side of the housing, with part of the aperture in the bottom of the housing and part of the aperture in the top of the housing.

Mounting holes are visible in the top of the housing. The mounting holes may be used, with screws for example, to mount the housing to in a cabinet. The mounting holes include slotted forward holes 117*a,b*, near opposing edges of the top and rear holes 119*a,b*, also near the opposing edges of the top. The slotted holes allow for slight forward and rearward movement of the housing during installation, with the rear holes allowing for fixing of position of the housing once the housing has been placed exactly as desired.

Also visible in FIG. 1 is a lanyard 115. The lanyard may be used for mechanical release of the bolt, with operation of the lanyard retracting the bolt generally within the housing.

Figure 2:
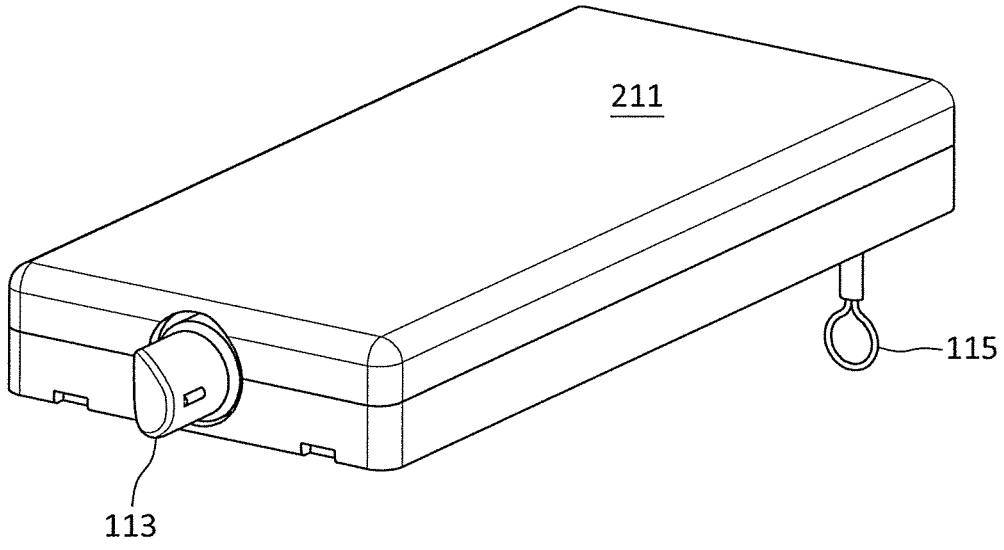
FIG. 2 is an isometric view of the lock assembly in accordance with an embodiment of the invention that includes a cosmetic cover to conceal the mounting points of the lock assembly.

FIG. 2 is an isometric view of the lock assembly in accordance with an embodiment of the invention that includes a cosmetic cover to conceal the mounting points of the lock assembly. Generally, FIG. 2 shows the embodiment off FIG. 1 with a cover 211 over the top of the housing. The cover may be useful in hiding from visible view the mounting holes and screws or other fastening devices placed in the mounting holes. The cover does not interfere with extension or retraction of the bolt 113, or restrict access to the lanyard 115.

Figure 3:
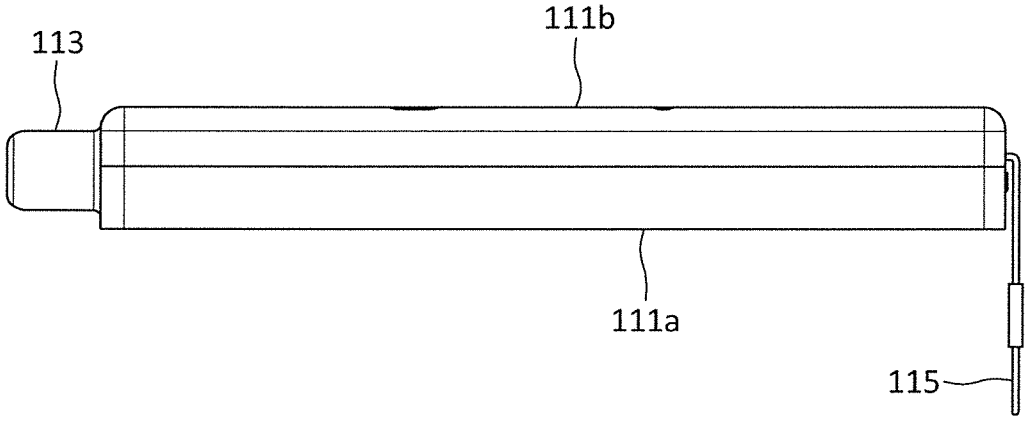
FIG. 3 is a side view of the lock assembly of FIG. 1, more fully illustrating the lanyard for manual release, for example in the event of a power failure.

FIG. 3 is a side view of the lock assembly of FIG. 1, more fully illustrating the lanyard for manual release, for example in the event of a power failure. The lanyard 115 may be seen as extending from a rear of the housing, hanging down due to gravity. As with the bolt 113, which extends through an aperture at a front of the housing, the lanyard extends through an aperture at a rear of the housing, with the aperture formed partially in the bottom 111*a* and top 111*b* of the housing.

Figure 4:
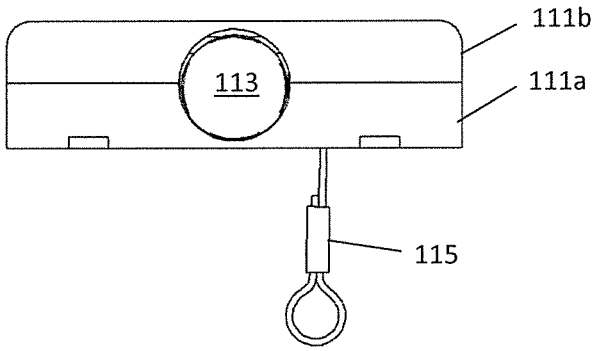
FIG. 4 is a front view of the lock assembly of FIG. 1.

FIG. 4 is a front view of the lock assembly of FIG. 1. As may be seen in the front view, the bolt 113 extends from the aperture formed partially in the bottom 111*a* and partially in the top 111*b* of the housing. The lanyard 115 is also partially visible, hanging below the housing.

Figure 5:
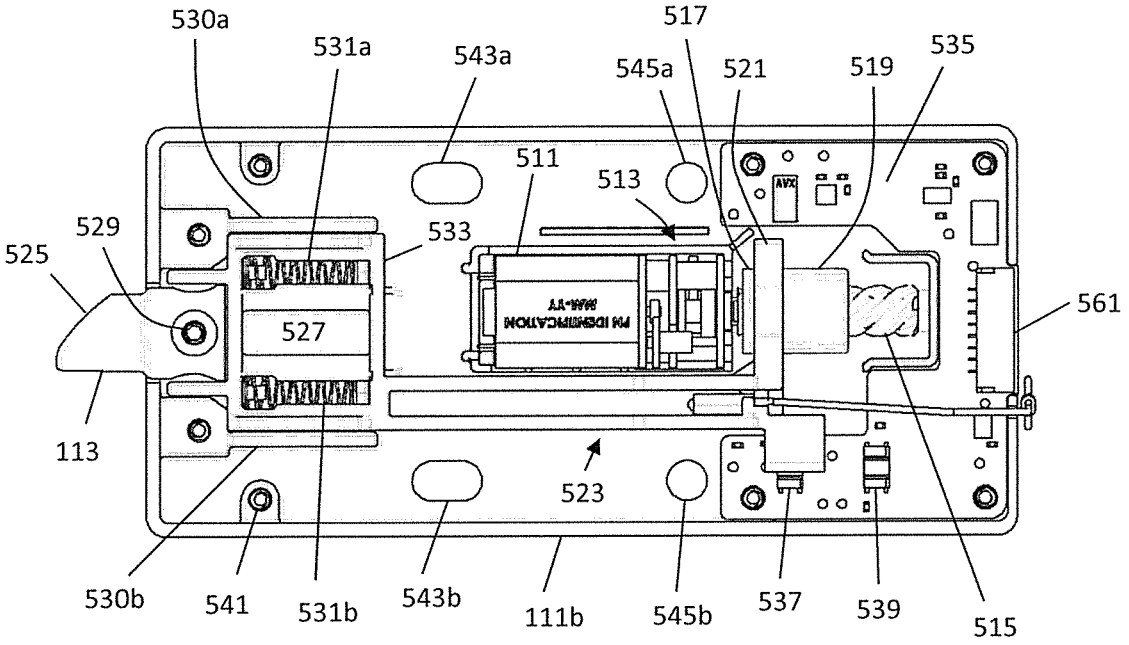
FIG. 5 is a top view of a lock assembly in accordance with aspects of the invention, with the top housing removed to reveal the internal components of the lock device, with a lock bolt in a locked position.

FIG. 5 is a top view of a lock assembly in accordance with aspects of the invention, with the top housing removed to reveal the internal components of the lock device, with a lock bolt in a locked position. A bolt 113, or pin is in the locked or extended position (with wires from motor terminals to an electrical connector not shown).

A motor 511 is maintained in position with respect to a base of the housing by upturned tabs extending upward from the base. The motor 511 drives a drive screw 515, through gearings 513. Operation of the drive screw translates a coupling 519 forward or rearward, depending on direction of operation of the motor. The coupling generally encompasses a circumference of the drive screw, with the coupling including an inner diameter threaded to mate with threads of the drive screw.

A moveable sled 523 has a rear end fitted around the coupling, to a rear of a forward flange 517 of the coupling (with forward and rear with respect to the housing). In most embodiments the sled is slip-fit to the coupling, as will be discussed below with respect to mechanical non-electrically powered release of the locking device. With the sled fitted around the coupling, and to the rear of the flange of the coupling, rearward translation of the coupling, due to operation of the motor and drive screw for example, results in rearward translation of the sled.

A bolt 113 is mounted to a shaft 527 of and about a forward end of the sled. A mounting screw 529 fixes position of the bolt with respect to the shaft. As illustrated in FIG. 5, the bolt extends through an aperture in the housing, with the bolt in a locking position. Rearward translation of the sled, for example due to operation of the motor, retracts the bolt into the housing, such that the bolt is in an unlocking position.

A forward end of the sled is maintained laterally in position, generally centered along a lengthwise access of the housing, by longitudinal tabs 530*a,b* extending upward from the base. The sled is biased towards a forward position, with the bolt in the locking position, by way of springs 531*a,b*. The springs, in the embodiment of FIG. 5, are compression springs positioned between a forward transverse surface of the sled and tabs (e.g. located at a position indicated by 533) extending upward from a bottom, or base, of the housing. The springs serve to generally maintain the sled in the forward position, absent other forces acting on the bolt or sled. As previously mentioned, operation of the motor may drive the drive screw so as to translate the sled rearward. In addition, closing of a sliding door may impact a slanted surface 525 on the bolt, driving the bolt and sled rearward, at least until a catch or other opening in the door allows for forward motion of the bolt. Further, as discussed with respect to FIG. 7, manual operation of a lanyard may also cause the sled to translate rearward.

Operation of the motor is controlled by circuitry on a circuit board 535 within the housing. The circuitry may include, for example a microprocessor, DSP, or other processing circuitry. In the embodiment of FIG. 5, the circuit board also includes a forward position sensor 537 and a rearward position sensor 539. The position sensors may be, for example, optical beam sensors, which may include a channel across which light is cast, with the sensors sensing passage or lack of passage of light across the channel. In such embodiments, a tab of the sled may ride over the sensors, with a flag extending downward into the channels. With the sensors and flags properly positioned with respect to one another, the forward sensor may sense when the sled is in a forward, or locking, position, and the rearward sensor may sense when the sled is in a rearward, or unlocking position. Information of the sensors may be provided to other of the circuitry of the circuit board, for example for use in operation of the motor. Information of the sensors may also be transferred to components outside of the housing. In this regard, a connector 561 couples the circuit board to wiring outside of the housing. The connector may allow for passage of information of the sensors to components outside of the housing, or for passage of a flag indicating lock/unlock status of the lock device based on information of the sensors. In addition, the connector may allow for provision of power to the lock device, as well as a trigger signal which may be used to command unlocking of the lock device. In some embodiments the lock device retracts the bolt on receipt of the trigger signal, allowing the cabinet door to be opened. After a delay, allowing for the door to be opened, the lock device may, in some embodiments, thereafter automatically extend the bolt, to allow for locking of the cabinet door when it shuts. In some embodiments the connector may be an FPC/FFC connector.

The bottom, or base, of the housing includes forward slotted mounting holes 543*a,b*, and rearward mounting holes 545*a,b*, corresponding in position to forward slotted mounting holes and rearward mounting holes, respectively, in a top (not shown in FIG. 5) of the housing. The base of the housing also includes a plurality of mounting screw holes, for example mounting screw hole 541, to receive screws passing through the top, allowing for mounting of the top to the base. In some embodiments the mounting screws are sufficient for holding the top to the base, with the top and base together serving to maintain vertical position of the components within the housing, to desired tolerances.

Figure 6:
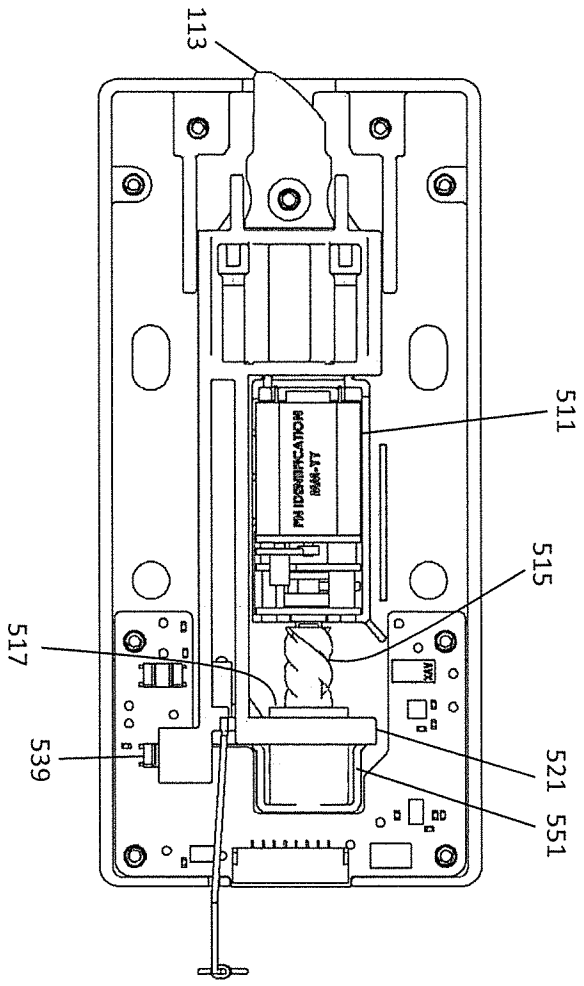
FIG. 6 is a top view of the lock assembly of FIG. 5, with the lock bolt in an unlocked position.

FIG. 6 is a top view of the lock assembly of FIG. 5, with the top removed, and with the lock bolt 113 in an unlocked position (with springs & wires not shown for clarity). In the unlocked position, the bolt is largely within the housing. In FIG. 6 the motor 511 has driven the drive screw so as to translate the coupling towards a rear of the housing, with the coupling bringing a rear 521 of the sled with it. The rear of the sled, as illustrated, abuts a holder 551 for the drive screw, with the holder also serving as a stop for the rear of the sled. With the sled translated towards the rear of the housing, the lock bolt is retracted into the housing in the unlocked position, and the flag extending from the tab on the sled blocks light from the rearward optical sensor.

Figure 7:
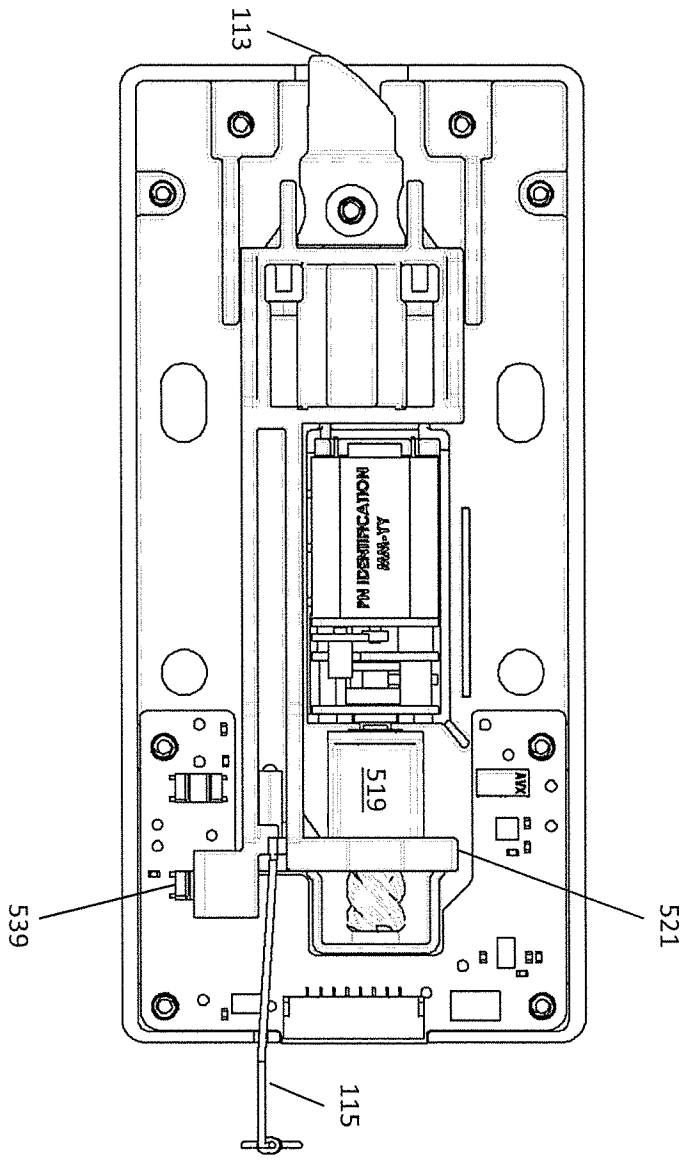
FIG. 7 is a top view of the lock assembly of FIG. 5, with the lock bolt in the unlocked position due to operation of a lanyard.

FIG. 7 is a top view of the lock assembly of FIG. 5, with the lock bolt 113 in the unlocked position due to operation of a lanyard 115. The lanyard is connected to the sled, such that pulling of the lanyard away from the housing causes the sled, and therefore the lock bolt, to translate rearward in the housing. Although the screw drive and coupling 519 remains in what corresponds to the locked position, the rearward movement of the sled causes the rearward sensor to indicate that the bolt is in the unlocked position.

The bolt may also be placed into the unlocked retracted position due to an external force on the bolt, for example a force providing by the sliding door against the slanted edge of the lock bolt.

Figure 8:
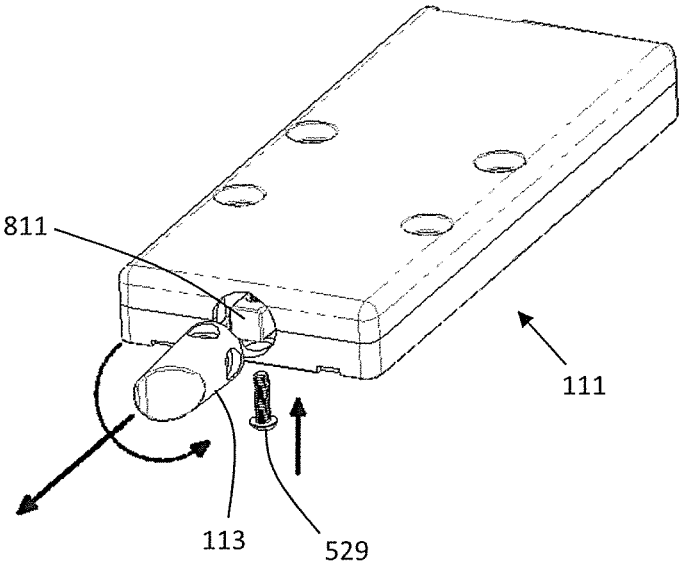
FIG. 8 is an isometric view of a lock assembly in accordance with aspects of the invention, showing the provisions for a rotatable striker to allow for multiple positioning of the locking device.

FIG. 8 is an isometric view of a lock assembly in accordance with aspects of the invention, showing provisions for a rotatable bolt, which may be considered a striker or pin, to allow for multiple positioning of the locking device. In FIG. 8, the housing 111 is shown with a square shaft 811 about the aperture for the bolt 113. The square shaft mates with a corresponding longitudinal cavity (not shown) in the bolt. The bolt itself includes radial holes at ninety degrees to one another, with the holes configured to receive a set screw 529 to hold the bolt in position with respect to the shaft. In the embodiment illustrated, the shaft also has a threaded hole to receive the set screw.

Figure 9:
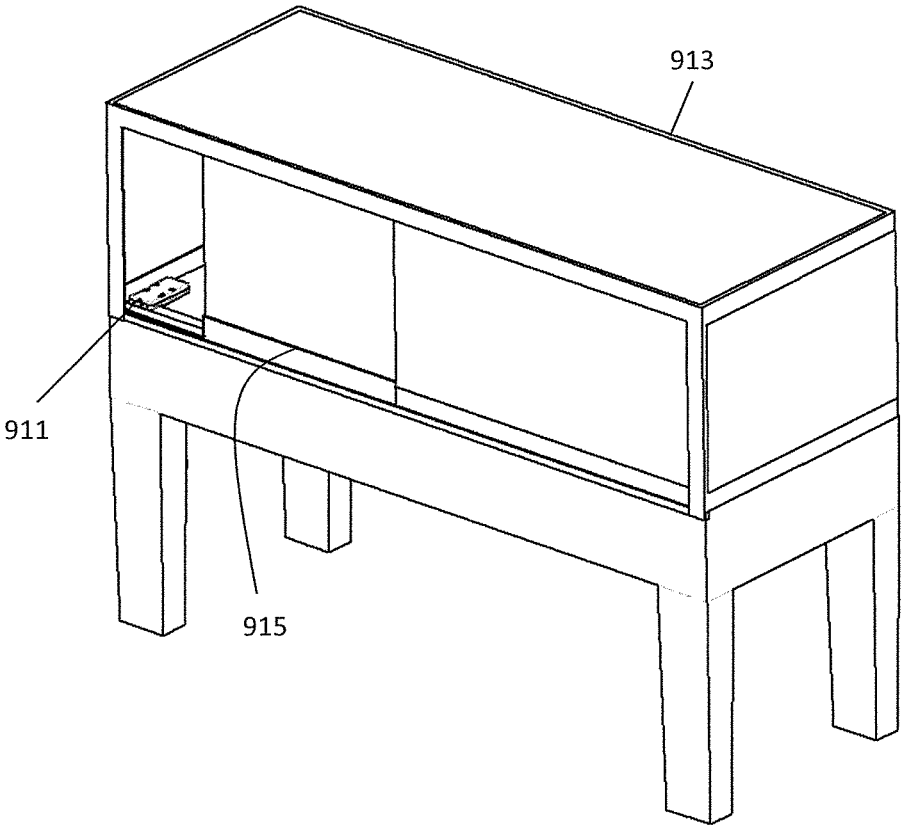
FIG. 9 is an isometric view of the lock assembly in accordance with aspects of the invention, showing the lock installed into a display cabinet with sliding doors.

FIG. 9 is an isometric view of a lock device 911, or assembly, in accordance with aspects of the invention, showing the lock installed into a display cabinet with sliding doors. The lock device may be a lock device as discussed with respect to FIG. 1 or 5, or as otherwise discussed herein. In FIG. 9, there is a glass display case 913. The display case contains glass on all sides to display any merchandise a retailer would like to display but keep secure. In most instances, the items on display would be high value items susceptible to potential theft. Retailer want to have these items on display, secure and readily accessible. The retailer also desires to have unobstructed views of the items on display and a locking device that does not detract or interfere with design and display of the items within the cabinet. The electronic lock is designed to meet this desire due to its compact size and its ability to be located in various locations within the cabinet. The lock device is shown on a lower surface of a storage area of the cabinet, about a sidewall of the cabinet. So positioned, a bolt of the lock device may engage with a catch on a sliding door 915 when the sliding door is in a closed position. The location shown in FIG. 9 is just one example of where the locking device can be located and installed.

Figure 10:
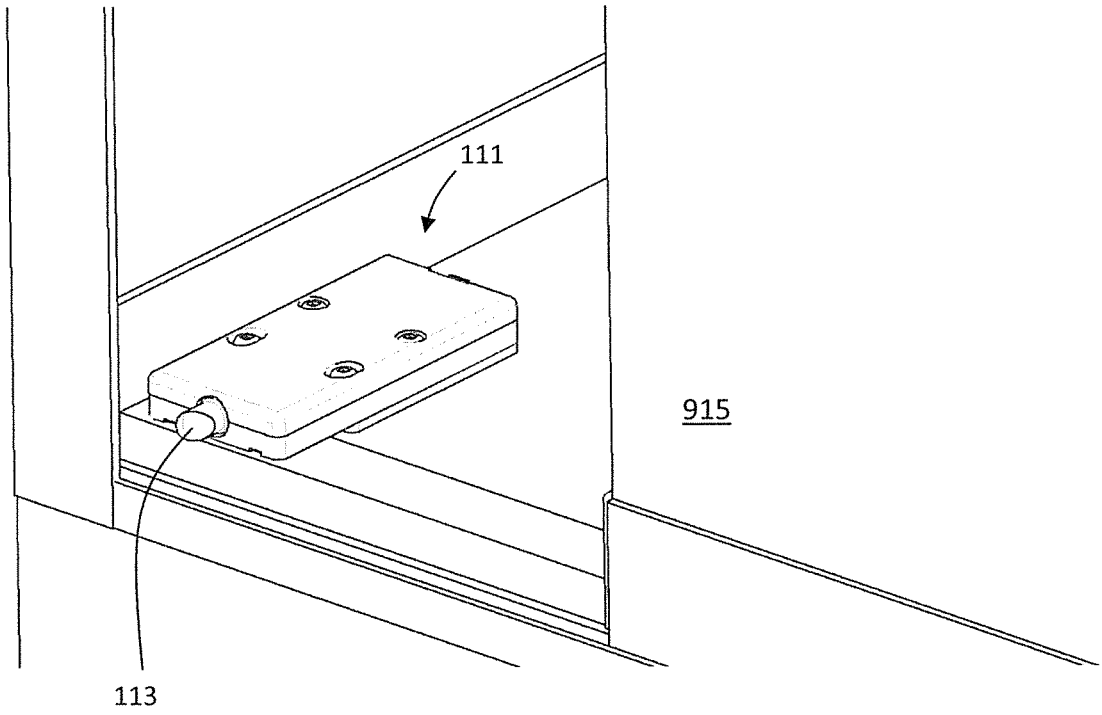
FIG. 10 is an isometric view of the lock assembly in accordance with aspects of the invention, showing a close up of the lock from FIG. 9, with the lock installed into a display cabinet with sliding doors.

FIG. 10 is an isometric view of the lock device 111 in accordance with aspects of the invention, showing a close up of the lock from FIG. 9, with the lock installed into a display cabinet with sliding doors, for example sliding door 915. The bolt 113 is shown in an extended or locking position, with the slanted end of the bolt facing towards and in a path of the sliding door. As the sliding door closes, the door, or a structure associated with a catch on an interior of the door, forces the bolt to retract into the housing of the lock device, at least until the bolt is positioned to enter the catch.

Figure 11:
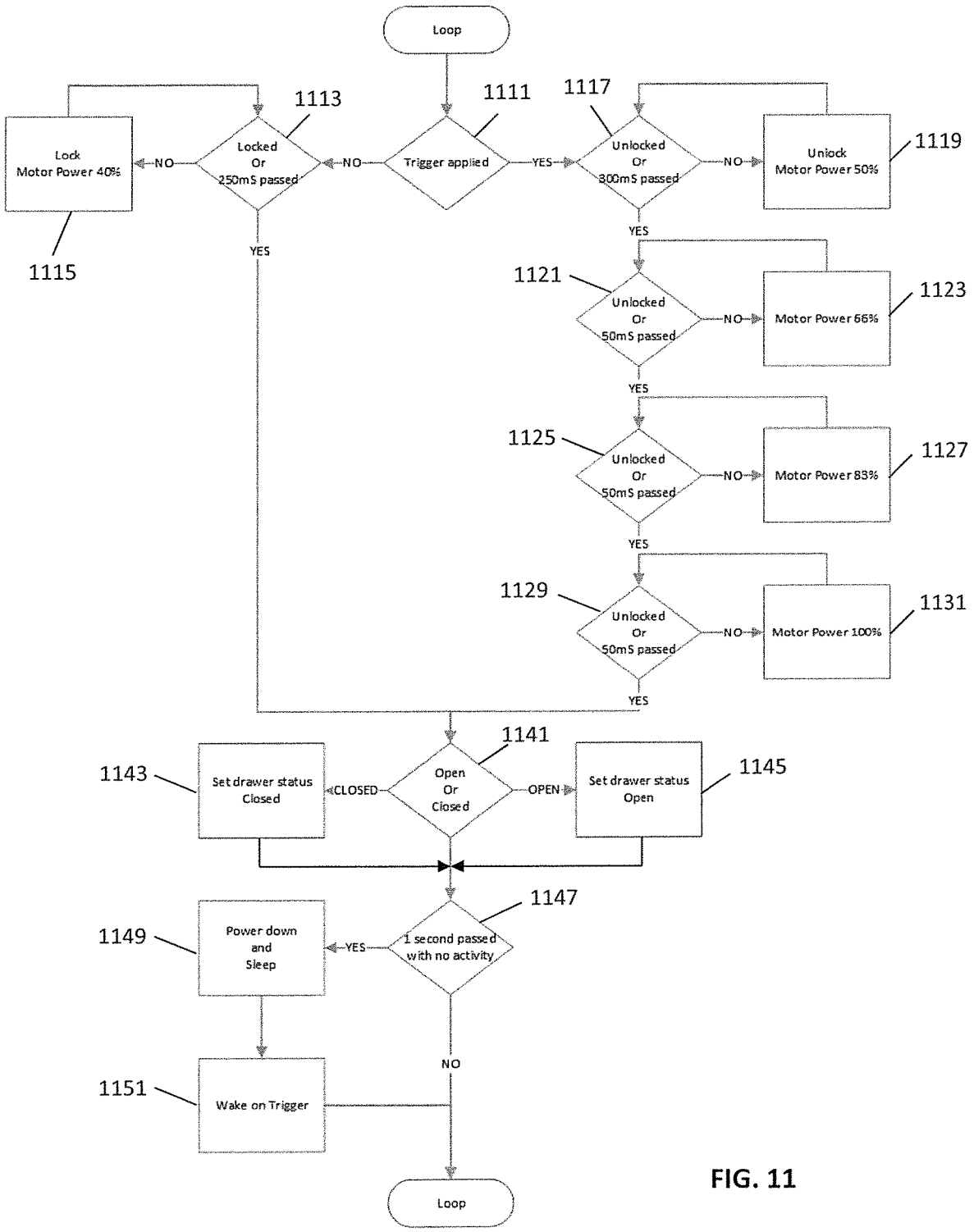
FIG. 11 is an operational flow chart of the lock assembly accordance with aspects of the invention.

FIG. 11 is an operational flow chart of a method of operation of the lock device or assembly accordance with aspects of the invention. In some embodiments the method is performed by the lock device of FIG. 1 or 5. In some embodiments the method is performed by circuitry of the lock device. In some embodiments the method is performed by a processor of a lock device. The pin could also engage with an aperture, cavity, or hole in the interior side of the sliding door, for example a shoe of the sliding door. In some embodiments the shoe may be of an extruded metal alloy.

In block 1111 the process determines if a trigger signal is received. The trigger signal may be provided by a control device remote from the lock in some embodiments. In some embodiments the control device is a controller for determining if access should be allowed to the cabinet, or, in some embodiments, multiple cabinets. In some embodiments the trigger signal is provided when by circuitry associated with an RFID reader, for example an RFID reader configured to detect presence of an appropriately coded RFID transmitter.

If no trigger signal is received, the process goes to block 1113, and determines if the lock device indicates the cabinet is locked or that a predetermined period of time has passed since a trigger signal has been received. If the cabinet is locked or the predetermined period of time has passed, the process proceeds to block 1141, discussed later. Otherwise the process proceeds to block 1115, and operates the motor to place the bolt in a locked position. In some embodiments, the motor is operated at less than a maximum power level, for example a 40% power level, for example to reduce power consumption of the lock device. After performing operations of block 1115, the process returns to block 1113.

If a trigger signal is received, as determined in block 1111, the process proceeds to block 1117. In block 1117, the process determines if the bolt is in an unlocked position or if a first predetermined time has expired. If not, the process in block 1119 operates the motor to place the bolt in an unlocked position, with the motor operated at a first power level. In some embodiments the first power level is fifty percent of a maximum power level, for example of the motor. After performing operations of block 1119, the process returns to block 1117.

If the bolt is unlocked, or if the first predetermined time has expired, the process continues to block 1121. In block 1121, the process determines if the bolt is in an unlocked position or if a second predetermined time has expired. If not, the process in block 1123 operates the motor to place the bolt in an unlocked position, with the motor operated at a second power level. In some embodiments the second power level is greater than the first power level, and in some embodiments the second power level is sixty six percent of a maximum power level. After performing operations of block 1123, the process returns to block 1121.

If the bolt is unlocked, or if the second predetermined time has expired, the process continues to block 1125. In block 1125, the process determines if the bolt is in an unlocked position or if a further second predetermined time has expired. If not, the process in block 1127 operates the motor to place the bolt in an unlocked position, with the motor operated at a third power level. In some embodiments the third power level is greater than the second power level, and in some embodiments the third power level is eighty three percent of a maximum power level. After performing operations of block 1127, the process returns to block 1125.

If the bolt is unlocked, or if a further second predetermined time has expired, the process continues to block 1129. In block 1129, the process determines if the bolt is in an unlocked position or if a still further second predetermined time has expired. If not, the process in block 1131 operates the motor to place the bolt in an unlocked position, with the motor operated at a fourth power level. In some embodiments the fourth power level is greater than the third power level, and in some embodiments the fourth power level is one hundred percent of a maximum power level. After performing operations of block 1131, the process returns to block 1129.

If the bolt is unlocked, or if the still further second predetermined time has expired, the process proceeds to block 1141, which the process may also reach based on the determination made in block 1113.

In block 1141, the process determines if the lock device indicates that the cabinet is open or closed. For example the cabinet may be closed if a door providing access to the cabinet is closed (or if a drawer of the cabinet is closed, for embodiments in which access to the interior of the cabinet is provided by way of a drawer). If closed, the process sets a lock (or door or drawer) status signal to closed, and proceeds to block 1147. If open, the process sets a lock (or door or drawer) status signal to open, and also proceeds to block 1147. In block 1147, the process determines if a significant amount of time has passed with no activity. In some embodiments the significant amount of time is one second. If a significant amount of time has passed with no activity, the process sets itself to a sleep mode (reduced power) in lock 1149, and proceeds to block 1151 to await a trigger signal. Otherwise the process returns.

Figure 12:
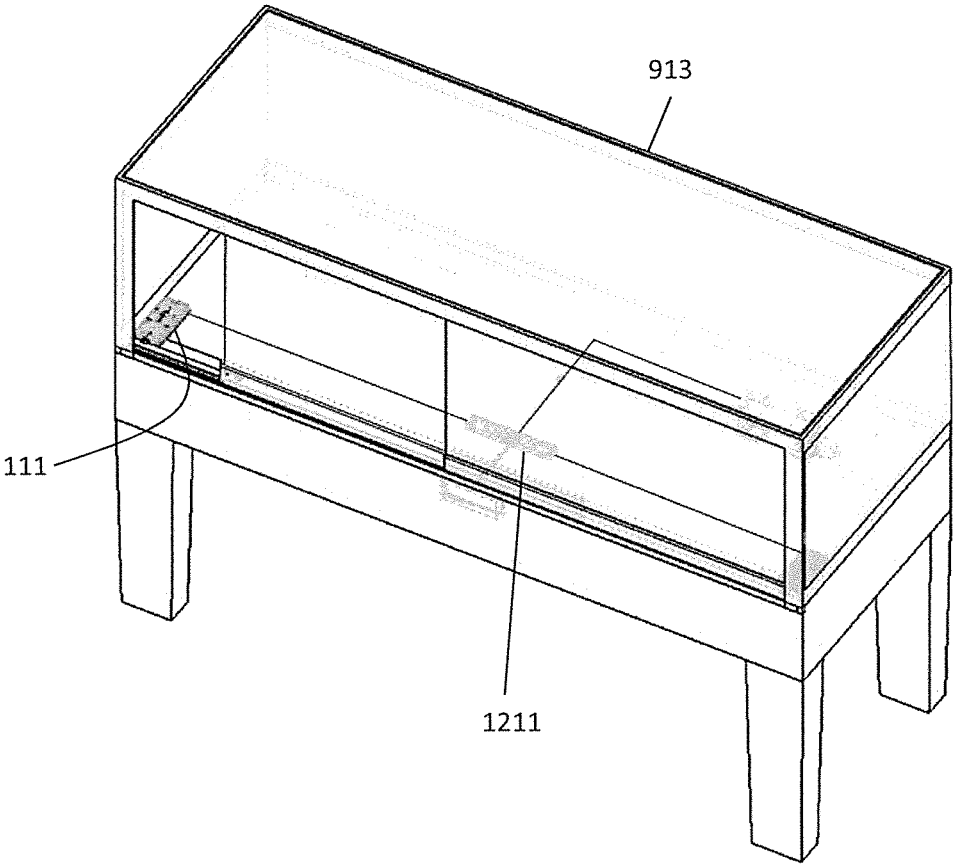
FIG. 12 is an isometric view of the lock assembly in accordance with aspects of the invention, showing the lock installed into a display cabinet with sliding doors, with an access control system below the cabinet structure.

FIG. 12 is an isometric view of the lock assembly 111 in accordance with aspects of the invention, showing the lock installed into a display cabinet 913 with sliding doors. The image also includes an access control system consisting of a concealed RFID reader positioned under the sliding door and behind the wood panel. It also includes a hub terminal 1211 that interconnect the lock devices, the reader and the power supply (shown in back right corner). In some embodiments the access control system may be as described in U.S. patent application Ser. No. 15/215,462, entitled ELECTRONICALLY CONTROLLED DRAWER SLIDE LOCKING FOR CABINETS AND HUB FOR SAME, filed on Jul. 20, 2016, the disclosure of which is incorporated herein by reference. The access control system are concealed and hidden from view.

Figure 13:
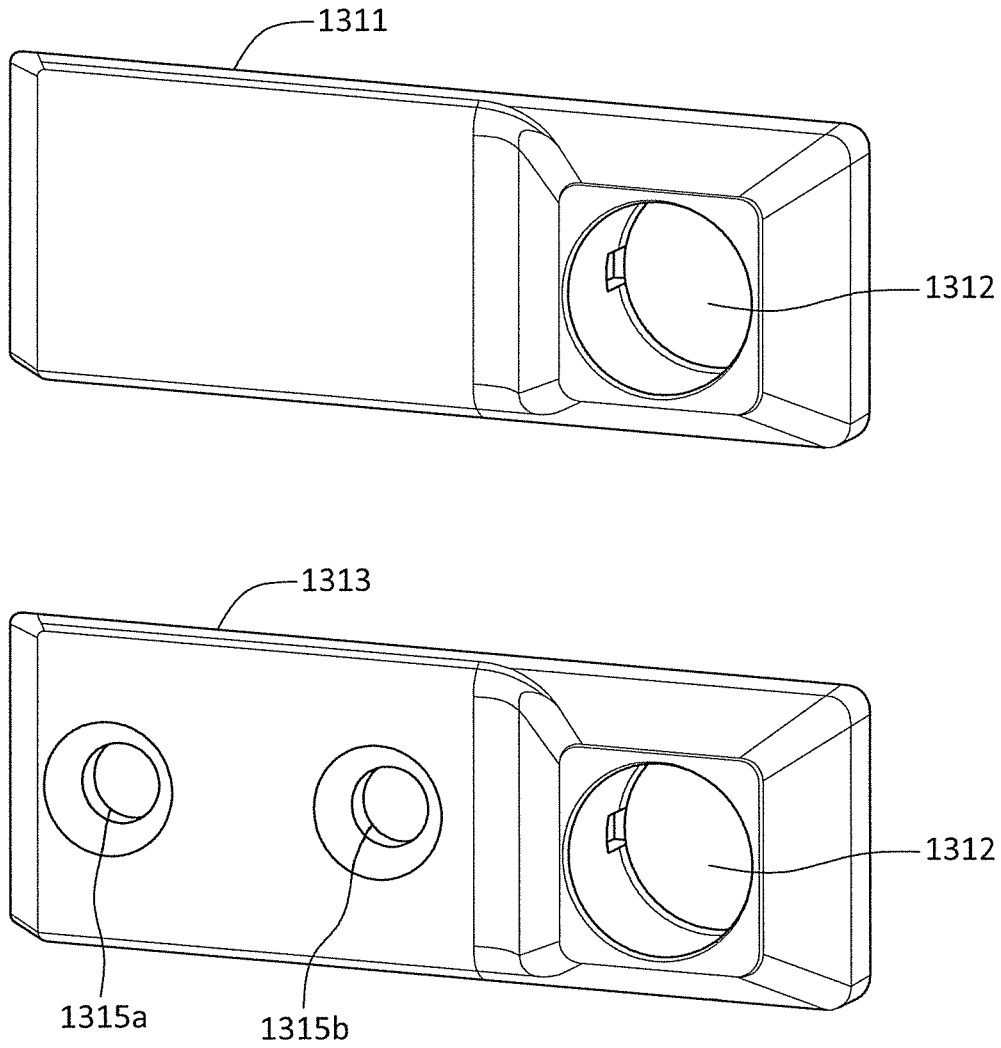
FIG. 13 is an isometric view of the surface mounting catch in accordance with aspects of the invention showing two versions, one version (top) is designed for attachment to glass panels the other version is designed for screw attachment to solid material panels.

FIG. 13 is an isometric view of the surface mounting catch in accordance with aspects of the invention showing two versions, one version 1311 is for attachment to glass panels, for example using an adhesive, the other version 1313 is for attachment with screws through screw holes 1315*a,b* to solid material panels. The catches 1312 are designed with a ramped surface and a center crater to receive the pin of the electronic lock.

Figure 14:
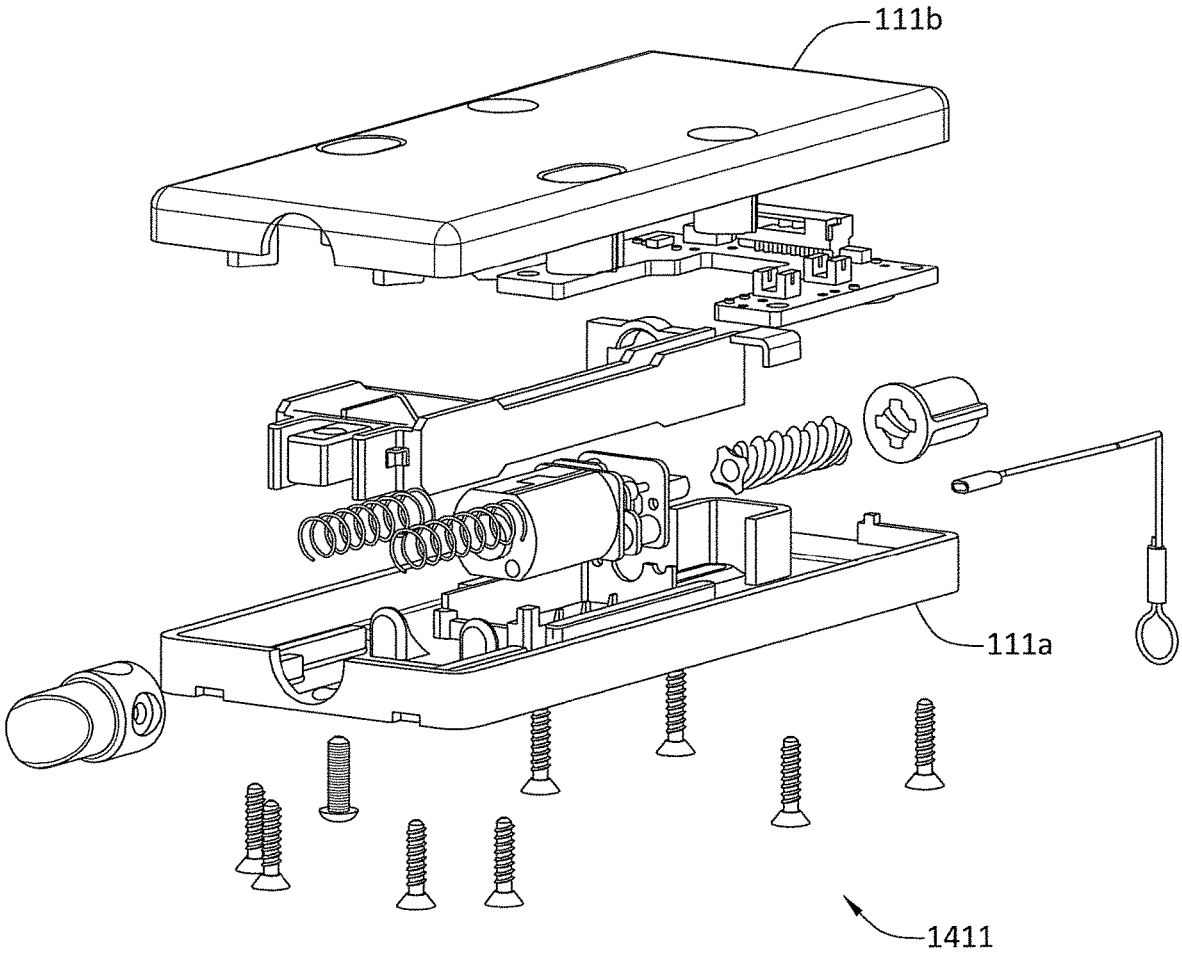
FIG. 14 is an exploded view of the locking device in accordance with aspects of the invention, showing the total of physical components of the design and that all of the internal components do not require any fasteners for installation.

FIG. 14 is an exploded view of the locking device in accordance with aspects of the invention, for example the locking device of FIG. 5, showing the total of physical components of the lock device. The embodiment of FIG. 14 shows the top 111*b* of the housing and the bottom of the housing 111*a*, and the internal components. Screws 1411 for fastening the top and bottom are also shown. In the embodiment of FIG. 14, all of the internal components do not require any fasteners for installation. The only fasteners used are to secure the upper and lower shells of the lock.

Figure 15:
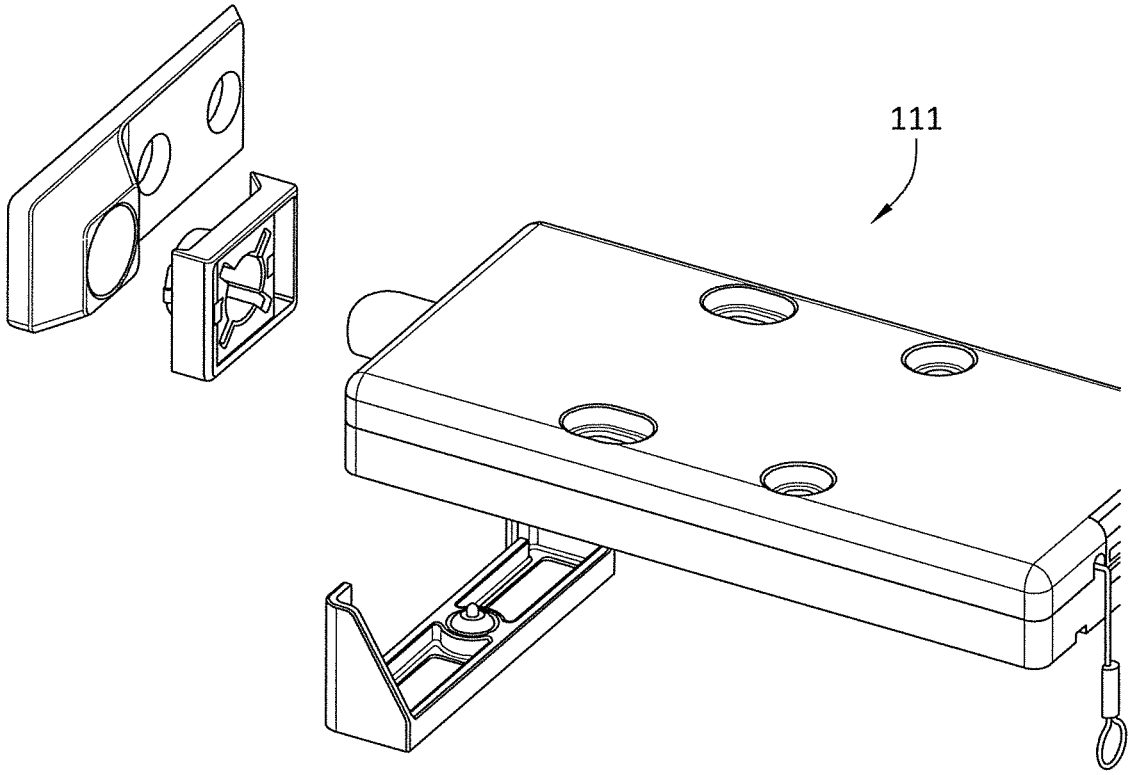
FIG. 15 illustrates an installation jig for a surface catch.

FIG. 15 is an installation jig for a surface catch. This works with both versions of the surface catch and allows easy positioning of the catch onto panels or doors. The jig snaps into the crater of the surface catch and the pin of the electronic lock 111 is inserted into the jig and is held via friction onto the jig. The bracket key under the lock is used to hold the pin in the extended position while the jig is pressed onto the pin. The catch can be oriented in any direction using the jig. Once the catch is properly located, the jig and bracket key can be discarded and recycled. This eliminates a need for measuring and transference of measurements from one location to another. In addition, the jig allows for 360 degree positioning of the catch, for example to allow for limited clearance.

FIGS. 16A-B and FIGS. 17A-B illustrate two additional embodiments of the electronic lock for sliding doors. Both embodiments depict a version of locking device incorporating at least one additional sensor, with two sensors illustrated for each embodiment, for detecting position of a catch relative to the locking device. In both embodiments, the sensors provide information to circuitry of circuit board, for example a processor, indicating whether the catch, and associated door, is in a closed position. This information, along with in some embodiments information as to whether the bolt, sometimes called a pin, is in an extended position, allows the circuitry to provide a secure status output to the onboard connector. In some embodiments this output can be monitored by an access control system coupled to the connector to provide information about the status of the lock (secure or unsecure). In some embodiments the lock may be considered secure when the lock's circuitry receives signals that at least one sensor, and in some embodiments two sensors, indicates that the catch, or magnets contained within the catch, is in position to receive the pin, and that the pin is fully extended. The pin position may be monitored, for example, by the forward and rearward sensors, which sense particular positions of the moveable sled to which the pin is coupled. In some embodiments the lock may be considered to be unsecure when either the lock is commanded to open, and/or the sensors are not detecting the magnets within the catch, and/or the pin is retracted or not extended.

Figure 16A:
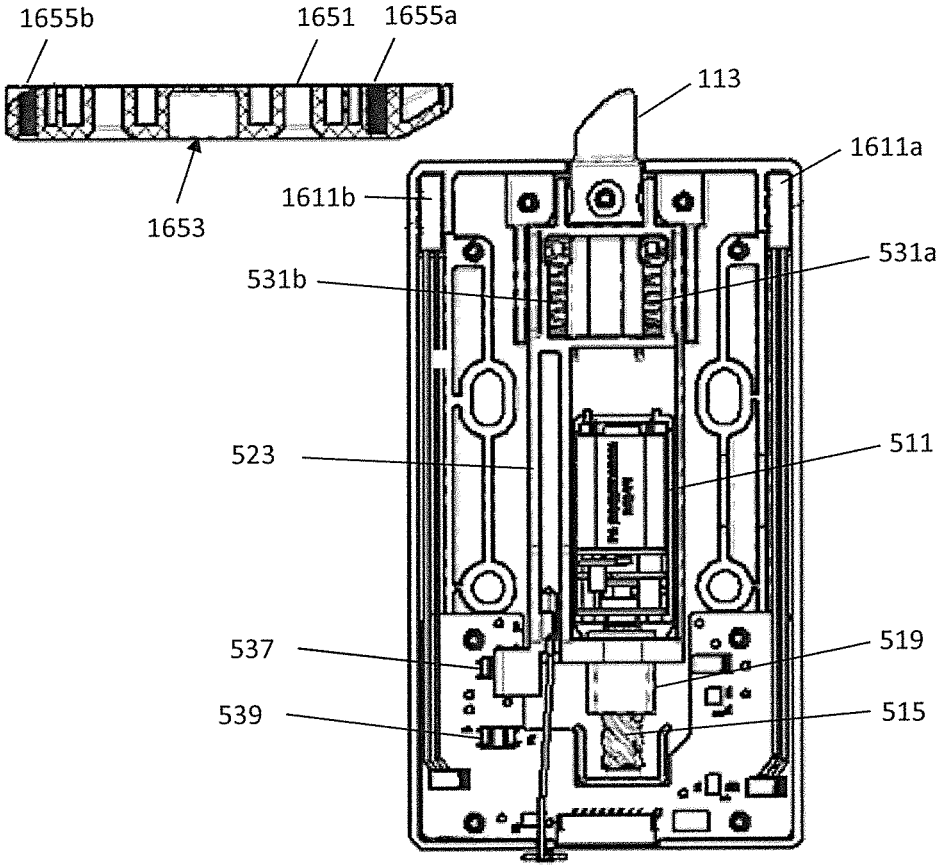
FIGS. 16A and 16B are top views of a locking device, including cut away of catch, with sensors for detecting position of the catch, in accordance with aspects of the invention.
Figure 16B:
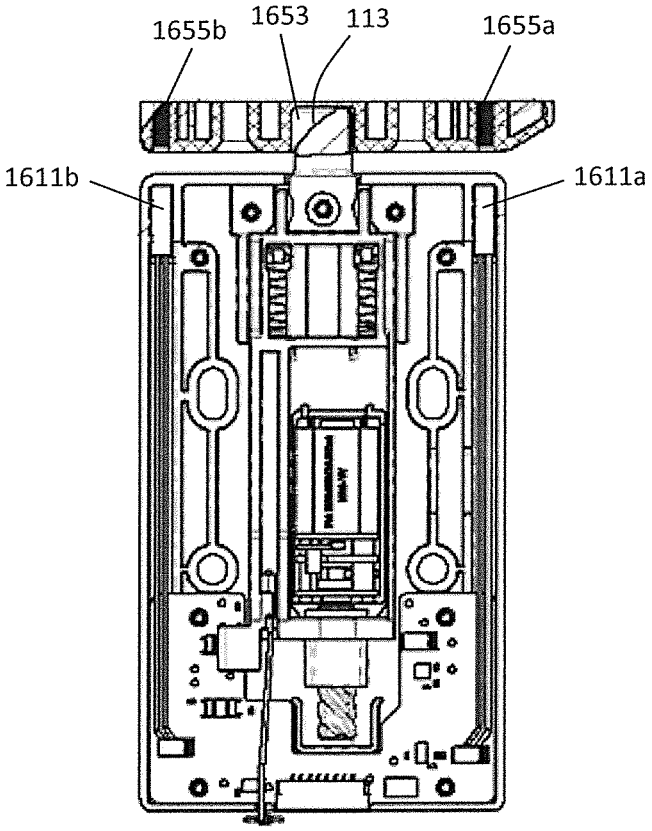

FIGS. 16A and 16B show a lock device with catch 1651 in a not closed (e.g. somewhat open) position and a closed position, respectively. The catch may be mounted on a sliding door, for example, or be an integral part of the door. The lock device may be mounted on a floor or shelf of an enclosure to which the door provides access, for example. The lock device may include components of the lock devices discussed herein.

In FIG. 16A, the lock device (with upper cover removed for clarity) is shown as having a bolt 113 (which may be termed in pin) extending from a housing of the lock device. The bolt is fixedly coupled to a moveable sled 523. The moveable sled is biased to a forward position by springs 531*a,b*, which may have one end abutting a portion of the sled and another end abutting tabs extending from a base of the housing. The sled includes a portion extending rearwardly, with a rearward portion of the sled slip fit over an interiorly threaded coupling 519. The interior threads of the coupling are mated to threads of a drive screw 515, which is driven by a motor 511, with the motor shown as being in a position between the bolt and the coupling.

In the example of FIG. 16, with the coupling positioned towards a forward end of the drive screw, the sled is normally biased towards a forward position with the bolt extending from the housing. Application of an external force, for example applied by the catch, may overcome the bias provided by the springs, and press the bolt into the housing, with the rear of the sled sliding over portions of the coupling. In operation, the motor may drive the drive screw, which causes the coupling to move forward or rearward, depending on direction of rotation of the drive screw. With the coupling moving rearward, the rearward portion of the sled, and the sled as a whole, is moved rearward, for example through contact of the rearward portion of the sled and a flange or other protuberance of the coupling. With the sled moving rearward, the bolt is also caused to be retracted into the housing. Similarly reverse operation of the motor causes the coupling to move forward, with the sled (and bolt) normally following due to the biasing effects of the springs.

A forward sensor 537 is positioned in the housing to detect when the sled is in a forward position, with the bolt extending from the housing. A rearward sensor 539 is positioned in the housing to detect when the sled is in a rearward position, with the bolt retracted into the housing. The forward sensor and the rearward sensor may both, for example, be optical sensors whose line of sight may be obstructed by a flag or tab extending from the sled.

The lock device additionally includes a pair of sensors 1611*a,b* about a side of the housing from which the bolt may extend. In FIG. 16A, a first sensor 1611*a* of the pair of sensors is on a right side of the housing, with a second sensor 1611*b* of the pair of sensors on a left side of the housing. In some embodiments, however, only a single sensor may be used. In such embodiments the single sensor may be positioned such that the sensor may only register when the catch is in a position to receive the bolt. Information of the sensors is provided to circuitry of the circuit board.

The pair of sensors may be, for example, reed sensors, activated by magnets 1655*a,b* in the catch. The magnets may be arranged in the catch such that the magnets only activate the sensors when the catch is positioned such that a receptacle 1653 of the catch may receive the bolt.

FIG. 16B shows the lock device with catch positioned in a closed position. In the closed position the bolt 113 is within the receptacle 1653 of the catch. In addition, in the closed position the magnets 1655*a,b* are adjacent the sensors 1611*a,b*, respectively, allowing the sensors to activate, or register that the door is in the closed position. In addition, as the sled is in the forward, or locking position, the forward sensor also indicates that the bolt is in the locking position. The circuitry of the circuit board may therefore determine both that the door is closed and the lock is in a locking state, with indications of both indicating that the door is secure.

In this regard, it is noted that the catch includes a leading edge which, when transitioning from the position of FIG. 16A to that of FIG. 16B, may apply a force to the bolt sufficient to overcome the bias of the springs and cause the bolt to be retracted into the housing. Upon reaching the position of FIG. 16B, however, the bias effect of the spring causes the bolt to extend out of the housing and into the receptacle.

Figure 17A:
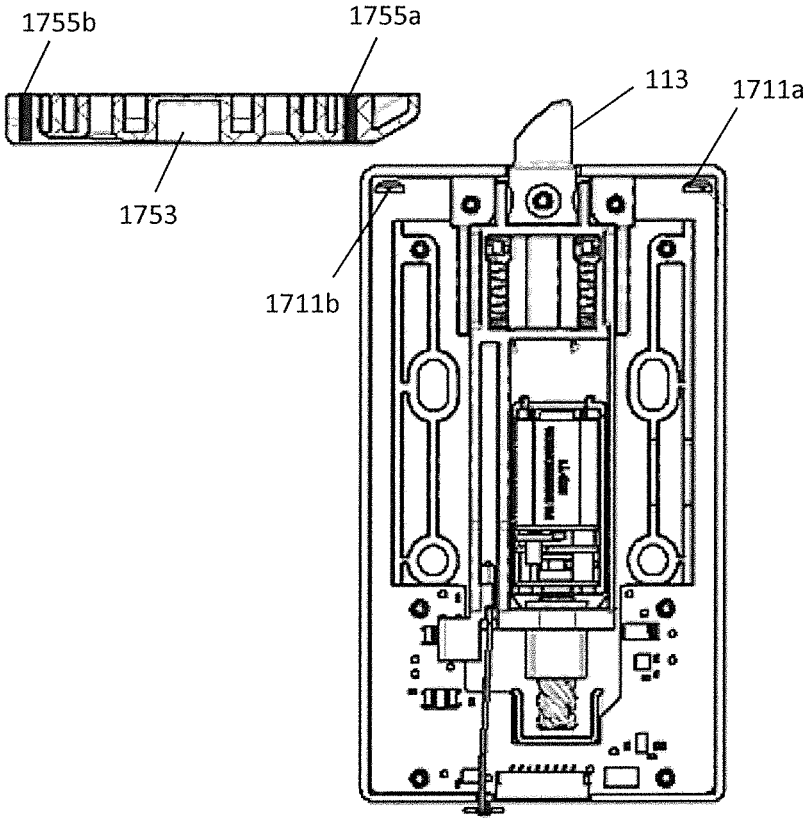
FIGS. 17A and 17B are top views of a further locking device, including cut away of catch, with sensors for detecting position of the catch, in accordance with aspects of the invention.
Figure 17B:
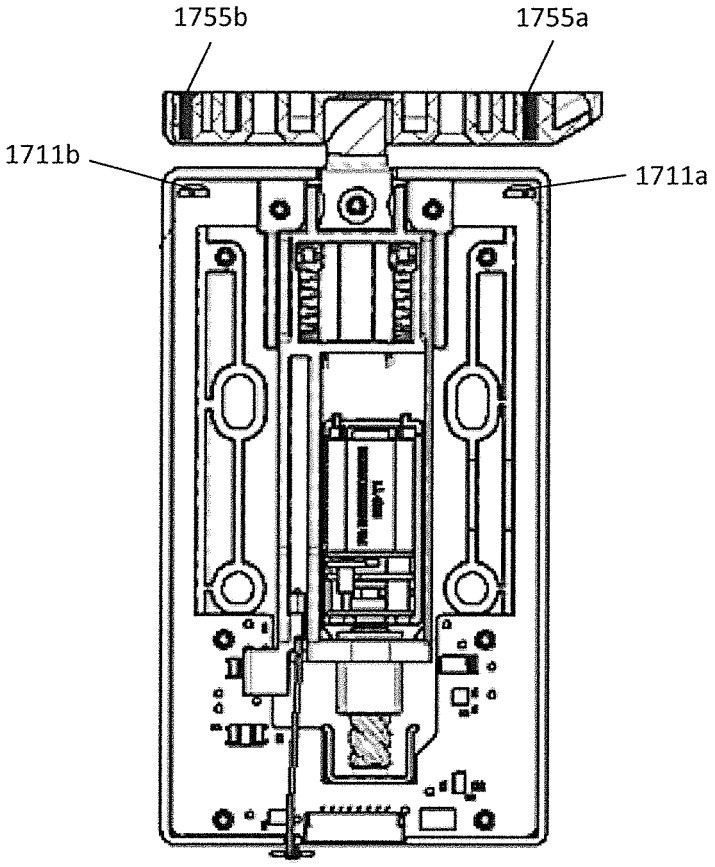

FIGS. 17A and 17B similarly show a lock device with catch in a not closed (e.g. somewhat open) position and a closed position, respectively. In FIGS. 17A and 17B the pair of sensors, positioned similarly to the sensors 1611*a,b*, may be for example Hall effect sensors. The Hall effect sensors may be activated by magnets 1755*a,b* of the catch, which also includes a receptacle 1753 to receive the bolt 113.

In some embodiments in accordance with FIGS. 16A-B or FIGS. 17A-B, the circuitry of the circuit board determines that the door is secure based on information of the first and second sensors and information of the forward sensor (and rearward sensor in some embodiments). In some embodiments the circuitry determines that the door is secure based on receiving an indication that the catch is proximate the locking device from the second sensor, followed by receiving an indication that the catch is proximate both the first and second sensors, and that the bolt is in the extended position (as indicated by the forward sensor). In some embodiments the circuitry determines that the door is secure based on sequentially a) receiving an indication from the first sensor that a magnet (of the catch) is proximate the first sensor and receiving an indication from the first sensor that the bolt is in the extended position, b) receiving an indication that the magnet is no longer proximate the first sensor and receiving an indication the bolt is no longer in the extended position, and c) receiving an indication from both the first and second sensors that magnets of the catch are proximate those sensors and receiving an indication from the forward sensor, that the bolt is in the extended position. In some embodiments the circuitry also requires that item c) follow item b) within a predetermined period of time, and in some embodiments item b) must also follow item a) within a predetermined period of time.

Although the invention has been discussed with respect to various embodiments, it should be recognized that the invention comprises the novel and non-obvious claims supported by this disclosure.

What is claimed is:

1. A lock assembly, comprising:

a housing;

a motor within the housing;

a drive screw within the housing, the drive screw drivable by the motor;

a coupling having an inner diameter threaded to mate with threads of the drive screw, the coupling translatable through operation of the drive screw, the coupling including a circumferential flange;

a bolt extendable through an aperture of the housing and retractable into the housing, with the motor being between the drive screw and the bolt; and a sled coupled to the coupling and the bolt, the sled having a portion slip-fitted around the coupling such that the sled is translatable relative to the coupling in a direction away from the circumferential flange of the coupling, with the circumferential flange of the coupling between the bolt and the portion of the sled slip-fitted around the coupling.

2. The lock assembly of claim 1, wherein the coupling encompasses a circumference of the drive screw.

3. The lock assembly of claim 1, wherein the bolt is coupled to the sled by way of a shaft.

4. The lock assembly of claim 3, wherein the bolt includes a longitudinal cavity to receive the shaft.

5. The lock assembly of claim 1, wherein the housing includes tabs extending from a base of the housing to maintain a lateral position of the sled.

6. The lock assembly of claim 1, further comprising at least one spring to bias the sled to extend the bolt through the aperture of the housing.

7. The lock assembly of claim 1, further comprising a circuit board with circuitry within the housing, the circuit board with circuitry to control operation of the motor.

8. The lock assembly of claim 7, wherein the circuit board includes a forward position sensor configured to sense when the sled is in a locking position, in which the bolt is normally extended from the housing.

9. The lock assembly of claim 8, wherein the circuit board includes a rearward position sensor configured to sense when the sled is in an unlocking position, in which the bolt is normally retracted in the housing.

10. The lock assembly of claim 9, further comprising a connector coupling the circuit board to wiring outside of the housing.

11. The lock assembly of claim 10, wherein the circuit board with circuitry is configured to operate the motor so as to result in retraction of the bolt into the housing upon receipt of a trigger signal received by way of the connector.

12. The lock assembly of claim 11, wherein the circuit board is configured to operate the motor so as to result in extension of the bolt through the aperture of the housing a predetermined time after receipt of the trigger signal.

13. The lock assembly of claim 10, wherein the circuit board with circuitry is configured to operate the motor, at a first power level, in order to retract the bolt into the housing upon receipt of a trigger signal received by way of the connector, to determine that the bolt has not been retracted into the housing based on a signal from the rearward position sensor, and to operate the motor at a second power level, greater than the first power level, in order to retract the bolt into the housing based on the determination that the bolt has not been retracted into the housing.

14. The lock assembly of claim 13, wherein the first power level is fifty percent of a maximum power level of the motor.

15. The lock assembly of claim 10, wherein the circuit board with circuitry is configured to operate the motor at a predetermined number of a plurality of increasing power levels until the bolt is retracted into the housing upon receipt of a trigger signal received by way of the connector.

16. The lock assembly of claim 9, further comprising at least one third sensor positioned to determine when a catch is positioned so as to receive the bolt.

17. The lock assembly of claim 16, wherein the at least one third sensor comprises a pair of sensors.

18. The lock assembly of claim 17, wherein the pair of sensors are positioned on opposite sides of the bolt.

19. The lock assembly of claim 16, wherein the circuit board with circuitry is configured to provide information of the forward position sensor, the rearward position sensor, and the at least one third sensor through a connector coupling the circuit board to wiring outside of the housing.

* * * * *